US006783602B2

(12) United States Patent
Gray

(10) Patent No.: US 6,783,602 B2
(45) Date of Patent: Aug. 31, 2004

(54) MULTISTEP SINGLE CHAMBER PARTS PROCESSING METHOD

(76) Inventor: Donald Gray, 9 McGraw Ct., Warwick, RI (US) 02818

( * ) Notice: Subject to any disclaimer, the term of this patent is extended or adjusted under 35 U.S.C. 154(b) by 0 days.

(21) Appl. No.: 10/668,408

(22) Filed: Sep. 23, 2003

(65) Prior Publication Data

US 2004/0055623 A1 Mar. 25, 2004

Related U.S. Application Data

(62) Division of application No. 10/047,584, filed on Jan. 15, 2002, now Pat. No. 6,743,300.

(51) Int. Cl.[7] ..... B08B 3/00; B08B 5/04

(52) U.S. Cl. ..... 134/10; 134/12; 134/21; 134/26; 134/30; 134/34; 134/36; 134/37; 34/298; 34/417; 34/423; 34/448

(58) Field of Search ..... 134/10, 12, 21, 134/26, 30, 34, 36, 37; 34/298, 417, 423, 448

(56) References Cited

U.S. PATENT DOCUMENTS 5,240,507 A * 8/1993 Gray et al. ..... 134/21
5,268,036 A * 12/1993 Neubauer et al. ..... 134/2
5,370,740 A * 12/1994 Chao et al. ..... 134/1
5,456,759 A * 10/1995 Stanford et al. ..... 134/1
5,702,535 A * 12/1997 Gray et al. ..... 134/10
5,800,626 A * 9/1998 Cohen et al. ..... 134/1.3
5,849,091 A * 12/1998 Skrovan et al. ..... 134/1
6,004,403 A * 12/1999 Gray et al. ..... 134/10
6,418,942 B1 * 7/2002 Gray et al. ..... 134/1.3

* cited by examiner

*Primary Examiner*—Zeinab El-Arini
(74) *Attorney, Agent, or Firm*—Barlow, Josephs & Holmes, Ltd.

(57) ABSTRACT

The present invention is directed to a method for controlled environment processing of parts in a chamber or chambers wherein solvents and/or solutions used for processing the parts can be introduced. The process includes applying a negative gauge pressure to the chamber to remove air or other non-condensable gases. Next a solvent, solvent mixture or solution in either a liquid or vapor state is introduced to the chamber. A first system is then applied to recover the solvent(s) or solution(s) from the object being processed and chamber, and a second system, separate from the first system, is applied that further recovers residual solvent or solution from the object and chamber. Treatment of the part may be in the form of coating, etching, deposition, cleaning, stripping, plating, adhesion, dissolving, penetrating, anodizing, impregnating, debinding or any other process in which material is removed or deposited on a solid surface by transfer from or to a liquid or gas phase.

12 Claims, 4 Drawing Sheets

MULTISTEP SINGLE CHAMBER PARTS PROCESSING METHOD

CROSS-REFERENCE TO RELATED APPLICATIONS

This application is a divisional of and claims priority from earlier filed U.S. patent application Ser. No. 10/047,584, filed Jan. 15, 2002 now U.S. Pat. No. 6,743,300.

BACKGROUND OF THE INVENTION

The instant invention relates to a new method for processing parts using solvents. More particularly the present invention relates to a single chamber solvent processing method whereby parts that require solvent processing can be subjected to multiple processing steps in one containment chamber.

In the finishing of metals, plastics, ceramics, composites and other materials, often many process steps are required either for intermediate processing or to produce a finished product. Some steps may include cleaning, drying, anodizing, film deposition, painting, impregnating, curing, heat-treating and other processes. Most of these steps require the use of organic solvents and/or inorganic chemicals, which often are regarded as environmental hazards, or health threats to workers. As a result, more often than not these processes are highly regulated by the EPA and/or local air and water pollution agencies. Quite often, these processes are carried out in special areas to either control emissions or limit ambient contamination between process steps. For these types of processes, it would seem advantageous to be able to perform multiple steps within a single chamber or enclosed environment in order to maintain the required quality control and/or limited emissions to the work place. Such a process method would improve the product quality and reduce pollution, labor costs and overall costs of controlled environment work areas such as clean rooms.

SUMMARY OF THE INVENTION

In this regard, the present invention is directed to a controlled environment processing chamber or chambers in which solvents and/or solutions used for processing a material can be introduced. The process includes a means of applying a negative gauge pressure to the chamber to remove air or other non-condensable gases. Means are provided for introducing a solvent, solvent mixture or solution in either a liquid or vapor state. A first system recovers solvent(s) or solution(s) from the object being processed and chamber, and a second system, separate from the first system, further recovers residual solvent or solution from the object and chamber. Treatment may be in the form of coating, etching, deposition, cleaning, stripping, plating, adhesion, dissolving, penetrating, anodizing, impregnating, de-binding or any other process in which material is removed or deposited on a solid surface by transfer from or to a liquid or gas phase.

In another aspect of the invention, a method of processing an object in an enclosed solvent processing system, including a solvent supply system in sealable communication with a cleaning chamber comprises the steps of:

(a) sealing the solvent or solution supply system with respect to the chamber;

(b) evacuating the supply system of air and non condensable gases and maintaining this air free environment (c) opening the chamber to atmosphere and placing an object to be processed in the chamber;

(d) evacuating the chamber to remove air and other non-condensable gases;

(e) sealing the chamber with respect to atmosphere;

(f) opening the chamber with respect to the solvent supply system and introducing a solvent or solution into the evacuated chamber;

(g) processing the object while maintaining an air free environment within the chamber;

(h) recovering and processing the solvent or solution introduced into the chamber within the closed circuit processing system;

(i) introducing another solvent or solution as a liquid, gas or vapor to further process the object;

(j) recovering and processing the $2^{nd}$ solvent or solution introduced into the chamber within the closed circuit processing system;

(k) repeating steps (h) and (i) as required;

(l) sealing the chamber with respect to the solvent supply system closed circuit solvent processing system;

(m) introducing air or other non condensable gases into the chamber for sweeping further solvent on the object and within the chamber; and (n) opening the chamber and removing the treated object.

The main objective of this invention is to maintain two or more solutions used for processing an object in two or more steps at a relatively constant concentration state from batch to batch. In order to accomplish this, a process must either prevent any mixing of solvent or solution vapors or liquids with previous solvents or solutions used in the processing, or separate solvents mixed during different processing steps to return the solutions to their starting compositions. Another main objective of this invention is to prevent solvents or solutions used in the processing from mixing with air, which would eventually lead to this solvent escaping the system as this air is discharged during the process. Any air used for solvent recovery, motive gas for vacuum, drying, curing, or other processing is internally circulated to provide a closed looped system requiring no discharge of air or solvent from the unit.

Another object of this invention is to provide an improved closed circuit solvent system and method, which enables solvent recovery and limits hazardous emissions. The invention can employ a variety of solvents having boiling points as low as 70 degrees Fahrenheit and as high as 500 degrees Fahrenheit.

Other objects, features and advantages of the invention shall become apparent as the description thereof proceeds when considered in connection with the accompanying illustrative drawings.

BRIEF DESCRIPTION OF THE DRAWINGS

In the drawings which illustrate the best mode presently contemplated for carrying out the present invention.

DETAILED DESCRIPTION OF THE INVENTION

Multiple step processing of materials within industries can vary in technique and processing chemicals. However, this processing invention can best be understood by reference to the following illustrative examples.

Figure 1:
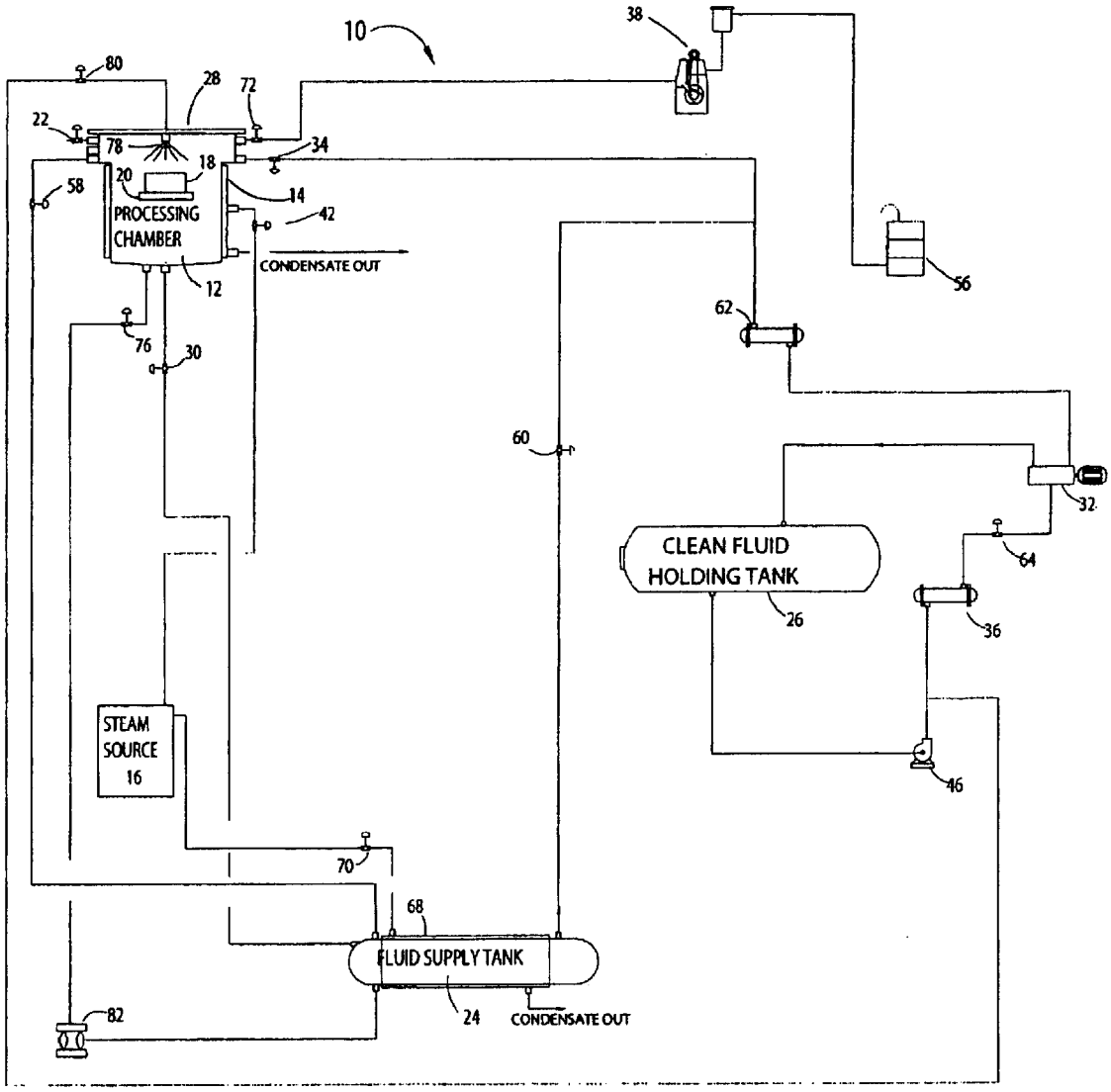
FIG. 1 is a schematic view of the preferred embodiment of the system used for the solvent processing method of the present invention.

This first example is a multi-step processing method utilizing mixtures of the same miscible chemicals, however, using different concentrations of the chemical mixture to treat an object at different times and to accomplish a different treatment method. An example of this process method would be the removal of contaminants from the surface of an object followed by the introduction of a different concentrated solvent mixture to remove any residual contaminant and/or wash solvent or solution. The rinse step could be used to enhance a third step such as a drying step. FIG. 1 is a depiction of this process. As an example of this process, a concentrated aqueous surfactant solution containing less than 10 wt % isopropanol (IPA) is used to clean a substrate followed by a liquid rinse with a solution containing greater than 50% IPA.

In FIG. 1, the process method 10 includes a cleaning chamber 12 having a jacket 14 in fluid communication with a heat source 16 (i.e., steam). An object 18 requiring cleaning is placed upon a support 20 fixedly mounted within the cleaning chamber 12. A valve 22, in fluid communication with the atmosphere and the cleaning chamber 12, is provided for selectively introducing air into the cleaning chamber 12.

The object 18 to be cleaned is placed into the cleaning chamber 12 on the support 20 through an opening created by removing a lid 28. After receiving the object 18, the lid 28 is secured to the cleaning chamber 12 wherein the cleaning chamber is sealed. The air handling vacuum pump 38 is used to remove virtually all the air from the cleaning chamber 12 through valve 72.

The aqueous cleaning solution is preferably introduced to the cleaning chamber 12 from a fluid supply tank 24 as a heated liquid soak as through pump 82 and valve 76. Typically, the solution can be circulated by opening the overflow valve 58 or drained and refilled by opening valve 30 and returning the solution to the fluid supply tank 24. The solution may be agitated as well as with jet pumps or spray nozzles on the inlet line through valve 76, or with typical ultrasonic transducers (not shown).

After the object 18 has been cleaned, any liquid solvent remaining in the cleaning chamber 12 is drained and/or pumped into the heated fluid solvent vessel 24 by opening valve 30. The drained liquid will also remove most of the chips or insoluble material, if present, and transfer them to the heated solvent vessel 24.

In a second step, a clean solution of IPA-water, richer in IPA, can now be sprayed on the substrate by opening valve 80, activating pump 46 and spraying the solution through nozzle 78. The cleaner, higher IPA concentrated solution rinses residual surfactants and contaminants from the surface and replaces excess water with a faster drying IPA solvent. The rinse solution is sent to the fluid supply tank 24 by opening valve 30.

Solvent vapors are next removed from the cleaning chamber 12 by means of a solvent handling vacuum pump 32. Specifically valve 34 is opened and vacuum pump 32 is activated and since there is no air present in this system, solvent vapors can be easily condensed in a heat exchanger 62 and the clean condensed solvent can be sent to the clean fluid holding tank 26 to be stored for reuse as clean spray for the next cleaning and rinse cycle. During this vapor-scavenging step, any residual solvent liquid remaining on the heated parts boils off the parts at the lower vacuum pressures, thus reducing solvent residual left in the vessel or on the parts. Since IPA dries faster and tends to spot less than water, a higher concentration of IPA enhances this drying process.

Upon removal of solvent vapor and liquid from the cleaning chamber 12, the chamber is then returned to atmospheric pressure by introducing ambient air through valve 22 to the cleaning chamber 12. Depending upon the vacuum level attained in the vapor-scavenging step, the cleaning chamber 12 may contain residual solvent vapors, which can be removed by evacuating the chamber 12 through valve 72 using a second vacuum pump 38. Collecting residual solvent in activated carbon filter 56 or in scrubbers or other conventional air stripping processes can treat the effluent air stream. This introduction of air followed by purging the cleaning chamber 12 can be repeated as many times as necessary prior to opening the cleaning chamber 12 and removing the cleaned article 18. In the preferred embodiment, ambient air may not be introduced to the chamber or the cleaned article 18 may not be removed from the chamber, and additional processing steps can be performed since the chamber can be completely void of air and chemicals or has been returned to the initial stage of containing just the article and ambient air.

In the process above, essentially all of the solvent has been recovered and therefore the overall concentration of the two solvents in the system 10 has not changed. The rinse used in the process, however is sent to the fluid supply tank 24, therefore there is a shift in the amount, and concentrations of the solvents in the fluid supply tank 24 and the clean fluid holding tank 26. The system can be returned to its' initial state by opening valve 60 and activating vacuum pump 32. The tank is then heated by opening valve 70 and introducing steam from source 16 to vessel jacket 68. The solvent vapor mixture is boiled from the fluid supply tank 24 and condensed in heat exchanger 62 and returned to clean fluid holding tank 26 through vacuum pump 32. The vapors are mixed with liquid solvent from the clean fluid holding tank 26, which is circulated to the vacuum pump 32 through pump 46, through heat exchanger 36 and through open valve 64. Upon distilling essentially all of the volume of the solvent mixture used previously in the rinse step over to tank 26, the concentrations and amount of solvent in each tank is essentially returned to their original amounts. In this example, since the IPA is more volatile than water, the clean fluid holding tank 26 will be richer in IPA and the fluid supply tank 24 will mostly contain water. Surfactants are relatively non-volatile and therefore the surfactants remain concentrated in the wash fluid supply tank 24.

Other types of two step wash-rinse processes would include a Normal Methyl Pyrolidone wash followed by a water rinse, a Trichloroethylene wash with an Ethanol rinse, a Tetrachloroethylene wash followed by a Methyl Alcohol rinse or a Normal Propyl Bromide wash with a 2,3-dihydrodeca-fluoropentane rinse.

Other examples of this type of process would include a two-step cleaning process in which the first step cleans organic contaminants with a lipophilic solvent followed by a cleaning of water-soluble contaminant with a hydrophilic solvent. Miscible mixtures of alcohols with halogenated solvents would be an example of the type of solvent mixtures that could be used. Methanol-Normal Propyl Bromide, Ethanol-Trichloroethylene, Isopropyl Alcohol-Tetrachloroethylene or Furfuryl Alcohol-2,3-dihydrodecafluropentane are some examples of mixtures, which could be used.

Figure 2:
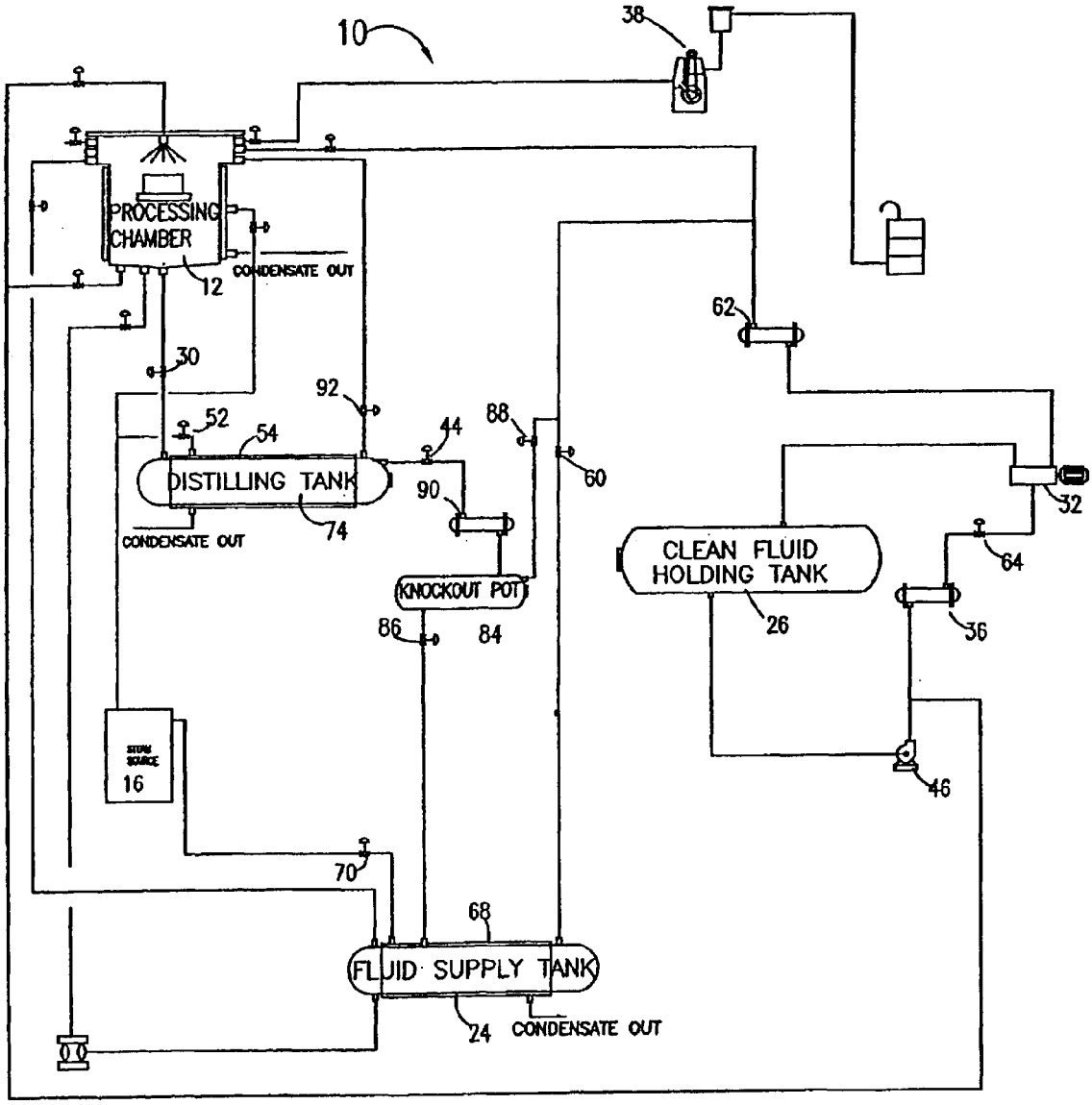
FIG. 2 is a schematic view of an alternate embodiment thereof.

The process above, although essentially eliminating the change in solution concentrations and amounts by preventing losses to the environment, does allow the accumulation of high boiling contaminants in the wash solution in fluid supply tank 24. FIG. 2 shows a process, which is an enhancement of the process method above. In the process 10 in FIG. 2, the addition of a second heated vessel 74 allows for a greater separation of the two component cleaning and rinse solutions, as well as providing for a continuous removal of waste from the cleaning solution. The process is similar to the process above, except that the cleaning solution at the end of the cleaning step is drained to the distilling tank 74 through valve 30 rather than directly to the fluid supply tank 24 as in the process above. This process 10 works well if the wash solution can be fully recovered for reuse by distilling. In the process above the surfactant used in the aqueous wash could not be recovered by distilling however if we replace the surfactant aqueous solution with tetrachloroethylene (PCE), the PCE could be distilled from distilling vessel 74 and returned to the fluid supply vessel 24 as clean wash.

In this system 10 in FIG. 2, the fluid supply vessel 24 would contain a higher concentration of tetrachloroethylene than the clean fluid holding tank 26 which would be richer in IPA. The PCE rich wash would preferably remove organic soluble contaminant and the IPA would rinse off the hydrophilic contaminants left behind after washing. The distilling tank 74 would contain a higher amount of solvent after receiving the wash and rinse from the process described above.

In the preferred embodiment, the distilling tank 74 can continuously distill to a knockout pot 84. The knockout pot 84, distilling tank 74 and heat exchanger 62 are first evacuated of non-condensable gases by opening valves 44 and 88 and activating vacuum pump 32. Upon evacuating the distilling tank 74, valve 88 is closed and valve 52 is opened introducing steam from source 16 to jacket 54. The evaporating PCE-IPA solvent mixture is condensed in heat exchanger 62 and collected in knockout pot 84. Once the solvent is sent to the knockout pot, valve 44 is closed, valve 86 is opened, and the solvent distilled PCE-IPA mixture is returned to the fluid supply tank 24 for reuse as a wash. The evaporating PCE rich mixture in the distilling tank 74 could also be used as a PCE rich vapor degreasing fluid for chamber 12 by opening valve 92 during the heating process above.

The PCE-IPA mixture in fluid supply tank 24 can now be further distilled to produce the rinse for the clean fluid holding tank 26. The system can be returned to its' initial state by opening valve 60 and activating vacuum pump 32. The tank is then heated by opening valve 70 and introducing steam from source 16 to vessel jacket 68. The solvent vapor mixture is boiled from fluid supply tank 24 and condensed in heat exchanger 62 and returned to the clean fluid holding tank 26 through vacuum pump 32. The vapors are mixed with liquid solvent from the clean fluid holding tank 26, which is circulated to the vacuum pump 32 through pump 46, through heat exchanger 36 and through open valve 64. Upon distilling essentially all of the volume of the solvent mixture over to the clean fluid holding tank 26, the concentrations and amount of solvent in each tank is essentially returned to their original amounts. In this example, since the IPA is more volatile than PCE, and the clean fluid holding tank 26 will be richer in IPA and the fluid supply tank 24 will be richer in PCE.

Figure 3:
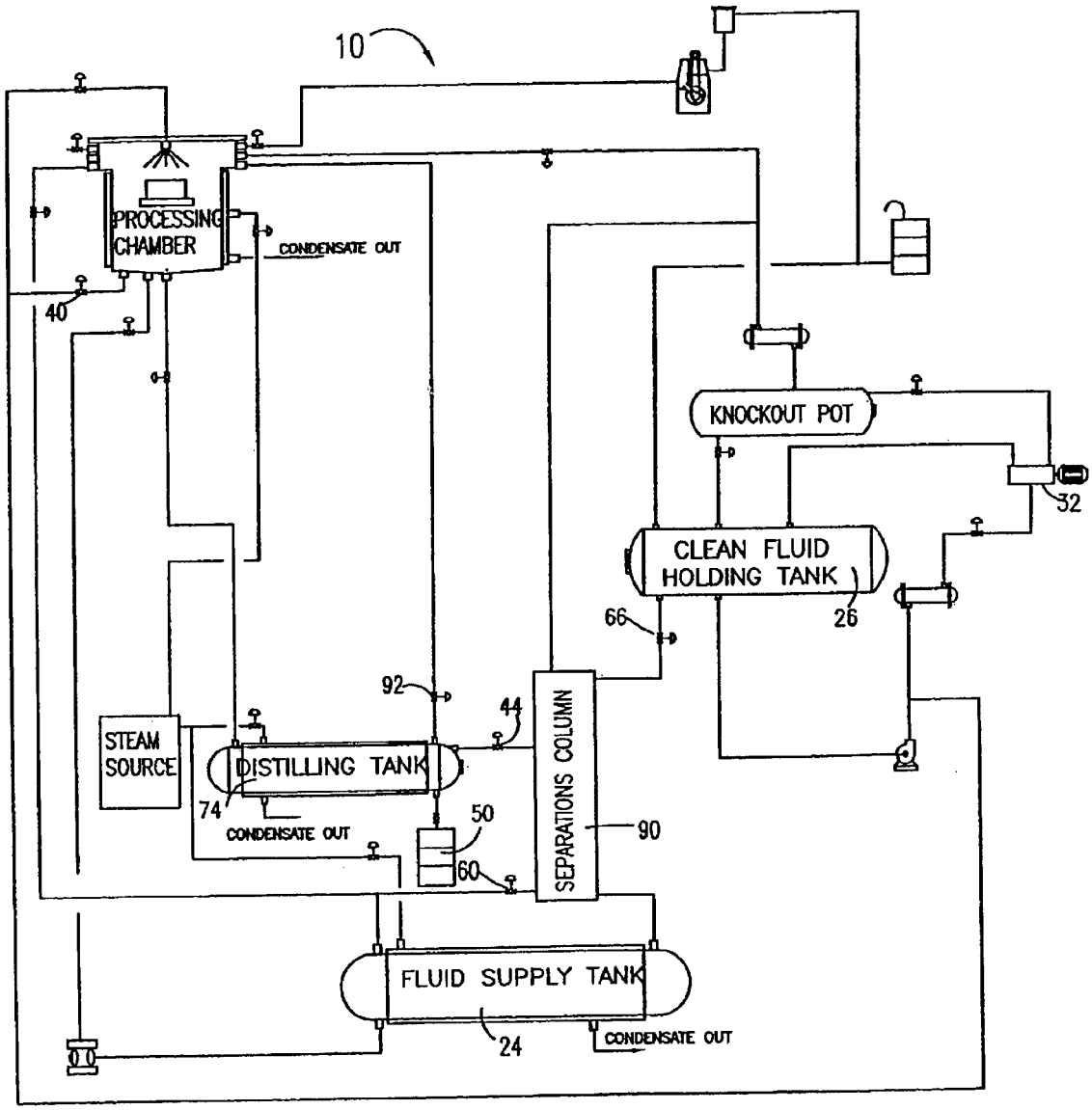
FIG. 3 is a schematic view of a second alternate embodiment thereof.

The modified process above is limited in the concentrations attainable for washing and rinsing because as mentioned, the solvent recovery system is only a two-stage process. FIG. 3 shows a process 10, which adds a separation column 90 to the process to replace the knockout pot in the modified process described above. The separation column 90 can be a plate, bubble, packed, spray or any other type of mass transfer equipment used to separate two or more solvent components into one or more streams of different solvent concentrations. In the process in FIG. 3, all the steps in the process described above can apply. The enhanced modification is in the recovery of the solvent mixtures. As depicted in FIG. 3, valve 44 opens into the separation column 90 to feed a vapor stream to be separated. If desired a liquid stream can be used and heated vessel 74 can be eliminated however in the preferred embodiment, heated vessel 74 separates contaminant from the solvent mixture prior to return as a wash solvent to be disposed of periodically in waste drum 50. Valve 60 in process 10 directs vapor from the fluid supply tank 24 to the bottom of the separation column 90 and valve 66 now directs recycled liquid to the top of the separation column. The net result is a greater concentration difference between fluid supply tank 24, which in this example would be richer in PCE and clean fluid holding tank 26 which would be richer in IPA. Changing the number of trays or height of packing, changing the quantity of liquid returned through valve 66 or vapor returned through valve 60, or changing the level of the vacuum pulled by vacuum pump 32 can now vary the amount of separation.

Process II

Figure 4:
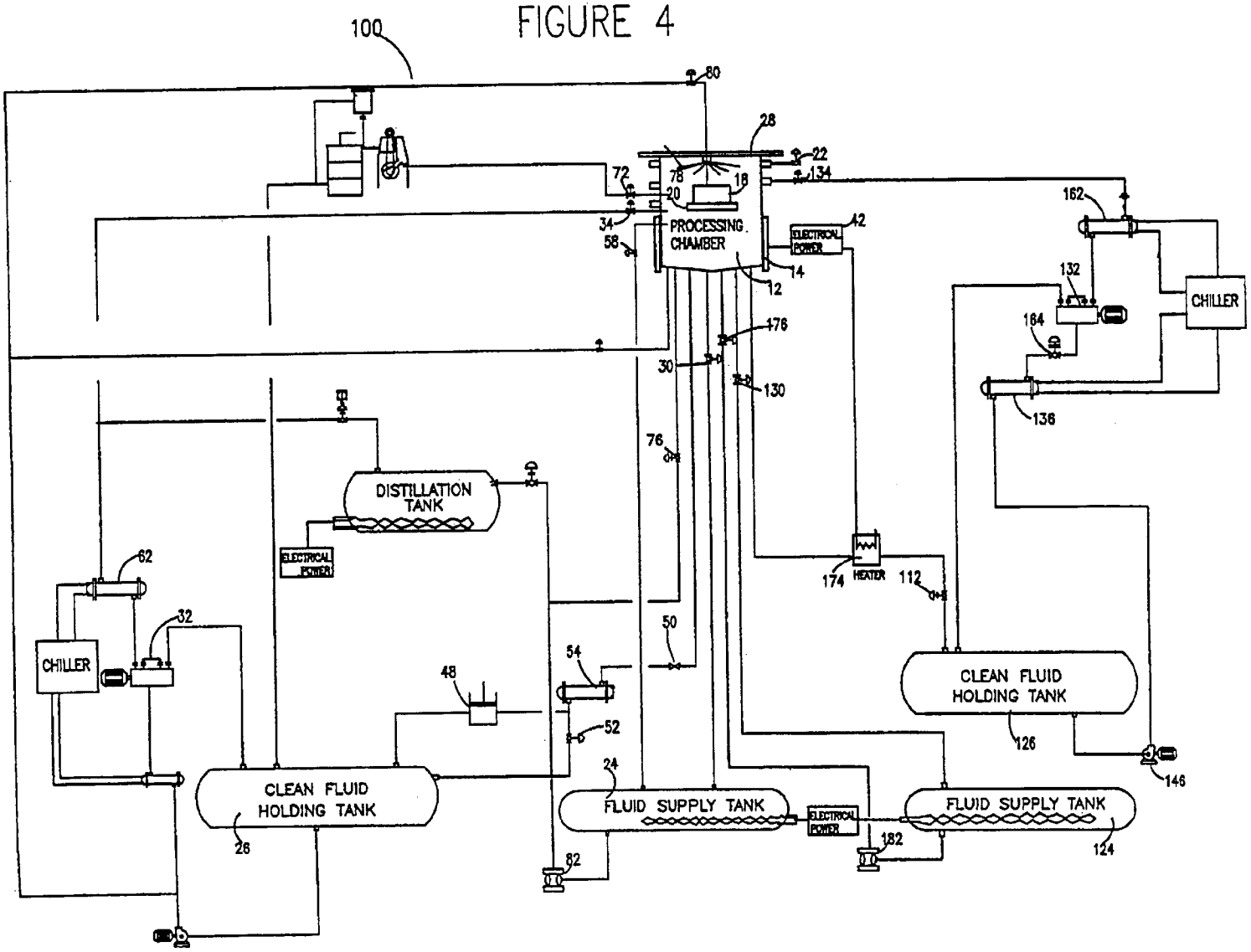
FIG. 4 is a schematic view of a third alternate embodiment thereof.

Another type of process is shown in FIG. 4 in which it may be desirable to keep miscible solvents and/or solvent mixtures involved in different processing steps completely separated. Process 100 in FIG. 4 shows a two-step process in which solvents are stored in two clean fluid holding tanks 26 and 126. An example might be an n-Propyl Bromide wash in fluid supply tank 24 and a 2,3-dihydrodecafluropentane rinse in fluid supply tank 124. In the process in FIG. 4, the system 100 includes a cleaning chamber 12 having a jacket 14 in electric communication with an electric heat source 42 for heating the chamber 12 walls. An object 18 requiring cleaning is placed upon a support 20 fixedly mounted within the cleaning chamber 12. A valve 22, in fluid communication with the atmosphere and the cleaning chamber 12, is provided for selectively introducing air into the cleaning chamber 12.

The object 18 to be cleaned is placed into the cleaning chamber 12 on the support 20 through an opening created by removing a lid 28. After receiving the object 18, the lid 28 is secured to the cleaning chamber 12 wherein the cleaning chamber is sealed. The air handling vacuum pump 38 is used to remove virtually all the air from the cleaning chamber 12 through valve 72.

The n-Propyl Bromide cleaning solvent is preferably introduced to the cleaning chamber 12 as a heated liquid soak as through pump 82 and valve 76. Typically, the solution can be circulated by opening the overflow valve 58 or drained and refilled by opening valve 30 and returning the solution to the fluid supply tank 24. The solution may be agitated as well as with jet pumps or spray nozzles on the inlet line through valve 76, or with typical ultrasonic transducers.

After the object 18 has been cleaned, any liquid solvent remaining in the cleaning chamber 12 is drained and/or pumped into the heated fluid supply vessel 24 by opening valve 30. The drained liquid will also remove most of the chips or insoluble material, if present, and transfer them to the heated solvent vessel 24.

Clean n-Propyl Bromide solvent from clean fluid holding tank 26 can now be sprayed on the substrate by opening valve 80, activating pump 46 and spraying the solution through nozzle 78. The cleaner n-Propyl Bromide solvent rinses residual solvent and contaminants from the surface. The rinse solvent is sent to the fluid supply tank 24 by opening valve 30.

Solvent vapors are next removed from the cleaning chamber 12 by means of a solvent handling vacuum pump 32. Specifically valve 34 is opened and since there is no air present in this system, solvent vapors can be easily condensed in a heat exchanger 62 and the clean condensed solvent can be sent to the clean fluid holding tank 26 to be stored for reuse as clean spray for the next cleaning and rinse cycle. During this vapor-scavenging step, any residual solvent liquid remaining on the heated parts boils off the parts at the lower vacuum pressures, thus reducing solvent residual left in the vessel or on the parts.

To ensure complete removal of n-Propyl Bromide from the object 18, chamber 12 and all piping attached to the chamber 12, air can be circulated through chamber 12 from the clean fluid holding tank 26. Since this air contains n-Propyl Bromide vapor, compression of the air-vapor mixture as in compressor 48 followed by cooling in heat exchanger 54 will reduce the saturation level of the air to produce a better gas for drying the chamber. The condensed vapor can be returned to the clean fluid holding tank 26 through valve 52. The air-vapor mixture is circulated from holding tank 26, through compressor 48 and heat exchanger 54, through throttling valve 50, through open valve 30 into the chamber and leaves the chamber through open valve 34, through heat exchanger 62 and vacuum pump 32 and back to the clean fluid holding tank 26. The air can be circulated either by activating compressor 48 or vacuum pump 32. After the compression, throttling the gas through valve 50 will produce the unsaturated gas state necessary for drying. The process is a closed loop so that no ambient gas is necessary therefore making it easier to maintain the same volume of solvent in clean fluid tank constant. Ensuring complete drying prevents cross contamination of future solvent with n-Propyl Bromide if added to the chamber 12.

In a second step, a heated rinse of clean 2,3-dihydrodecafluropentane can now be introduced to the cleaning chamber 12 by opening valve 176 and turning on pump 182. The lower boiling 2,3-dihydrodecafluropentane for instance can remove fluorinated organic material, which are not always soluble in other halogenated solvents.

If contaminants are being removed in the rinse step, a third step, a clean 2,3-dihydrodecafluropentane solvent rinses residual solvent and contaminants from the surface and replaces excess contaminated 2,3-dihydrodecafluropentane with a cleaner drying 2,3-dihydrodecafluropentane solvent. The rinse solution is sent to the fluid supply tank 124 by opening valve 130.

Solvent vapors are now removed from the chamber 12 by means of the solvent handling vacuum pump 132 through valve 134 and condenser 162 and the solvent is sent to clean fluid tank 126.

Enhanced drying can be attained by opening valve 112 and allowing air from holding tank 126 to first be heated by heater 174 in connection with electrical source 42 and passing through valve 112 and chamber 12. The drying air and solvent are circulated back to holding tank 126 through valve 134 and vacuum pump 132 after being chilled in heat exchanger 162. Vacuum pump 132 is sealed with 2,3-dihydrodecafluropentane circulated through circulation pump 146 and valve 164 from holding tank 126, which is chilled in heat exchanger 136. Heat exchanger 136 can be cooled by a chiller 144 or with any other type of cooling medium such as city or cooling tower water.

Upon removal of solvent vapor and liquid from the cleaning chamber 12, the chamber is then returned to atmospheric pressure by introducing ambient air through valve 22 to the cleaning chamber 12. Depending upon the vacuum level attained in the air-drying step, the cleaning chamber 12 may contain residual solvent vapors, which can be removed by evacuating the chamber 12 using a second vacuum pump 38. Collecting residual solvent in activated carbon 56, scrubbers, or other conventional air stripping processes can treat the effluent air stream. This introduction of air by opening valve 22 followed by purging the cleaning chamber 12 with pump 38 can be repeated as many times as necessary prior to opening the cleaning chamber 12 and removing the cleaned article 18. In the preferred embodiment, the cleaned article 18 is not removed from the chamber, and an additional processing step is begun since the chamber has been returned to the initial stage of containing just the article and ambient air.

The following is a sample list of methods for treating objects utilizing Process II above. In the coating industry, solvents can first be introduced to clean an object and then drained and dried. The second step in the process can be any in the list that follows: Spray painting the object: followed by solvent cleaning of the vessel walls: followed by drying of the vessel and fixtures: followed by curing the paint with superheated air-vapor mixtures. Introduction of caustic aqueous solutions to treat metal surfaces: followed by rinsing of the surface with water: followed by plating, deposition of corrosion inhibitors or anodizing the surface.

In the semiconductor business, a step might include one or more aqueous washes, one or more aqueous rinses, one or more caustic bath treatments (i.e. hydrofluoric acid solutions, NAOH solutions etc), solvent washes or rinses, and air-drying and water or solvent recovery.

In the dry cleaning or rag cleaning industry, a step may include one or more aqueous washes, one or more aqueous rinses, one or more solvent washes or rinses and air-drying.

In the general industrial equipment industries, a step may be a solvent or aqueous solution soak to remove contaminants, dewax materials, remove debinders, remove paints, remove solvents from surfaces, remove maskant and other process coatings, remove excess processing fluids or remove particles and foreign process debris. The second step could be to provide a second wash with a different solution or solvent or solvent concentration; coat objects such as with oil, polymer or maskant; fill object such as in impregnating with polymers or oils; abrasive treatment of surfaces such as in sand blasting, $CO_2$ surface blasting or high pressure water treatment; deposition of material such as surfactants from liquid solutions for corrosion inhibition or vapor deposition as thin film coating; vapor degreasing such as with trichloroethylene or methylene chloride or surface treatments such as in acid etching.

The above examples of the present invention have been described for purposes of illustration and are not intended to be exhaustive or limited to the steps described or solvents used in the descriptions. The scope of the invention is wide and can cover many industries and processes as illustrated in the sample examples stated. It will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed:

1. A method of treating an object in a closed circuit solvent processing system, said system including a chamber, a first fluid supply tank in communication with said chamber and a second fluid supply tank in communication with said chamber, said method comprising the steps of:

placing an object to be processed in said chamber, said chamber being filled with air;

sealing said chamber;

reducing a pressure within said chamber to evacuate the air from said chamber to create a vacuum condition;

introducing a first fluid to said evacuated chamber from said first fluid supply tank to process said object;

removing said first fluid from said chamber to a first fluid holding tank to restore said vacuum condition;

drying said object and said chamber;

introducing a second fluid to said evacuated chamber from a second fluid supply tank to process the object;

removing said second fluid from said the chamber to a second fluid holding tank;

drying said object and said chamber;

introducing a non-condensable gas to said chamber to return the pressure within said chamber to atmospheric pressure; and opening said chamber to remove said object.

2. The method of treating an object in claim 1 wherein said step of reducing the pressure within said chamber comprises reducing the pressure to between atmospheric pressure and zero absolute pressure.

3. The method of treating an object in claim 1 wherein said first and second fluids are selected from the group consisting of: organic solvents, water and aqueous solutions.

4. The method of treating an object in claim 1 wherein the method used in the steps of introducing said first fluid and said second fluid into said chamber is selected from the group consisting of: liquid spray and liquid soak.

5. The method of treating an object in claim 1 wherein the fluid state of said first and second fluid during the steps of introducing said first fluid and said second fluid into said chamber is selected from the group consisting of: vapor, gas-vapor mixture and aerosol spray.

6. The method of treating an object in claim 1 wherein said first fluid in said first fluid supply tank and said second fluid in said second fluid supply tank are comprised of a mixture of chemicals, wherein the mixture of chemicals in the first tank and the mixture of chemicals in the second tank are both a mixture of the same chemicals in differing concentrations.

7. The method of treating an object in claim 1 wherein said first fluid in said first fluid supply tank and said second fluid in said second fluid supply tank each contain a mixture of different chemicals.

8. The method of treating an object in claim 1 wherein said step of recovering said first fluid from said chamber further comprises:

withdrawing a first portion of said first fluid from said chamber in a liquid state; and withdrawing the remaining portion of said first fluid from said chamber in a vapor state, and said step of recovering end retaining said second fluid from said chamber further comprises:

withdrawing a first portion of said second fluid from said chamber in a vapor state; and withdrawing the remaining portion of said second fluid from said chamber in a vapor state.

9. The method of treating an object in claim 8 wherein said step of withdrawing first and second fluids in a vapor state further comprises:

reducing the pressure in said chamber causing said first and second fluids to flash to form a vapor; and withdrawing said vapor from said chamber.

10. The method of treating an object in claim 8 wherein said step of withdrawing said first and second fluids fluid in a vapor state further comprises:

circulating an unsaturated mixture of air and vapor from said first and second fluids in a closed loop between said first and second fluid holding tanks and said chamber to dry said object and remove said vapor from said chamber.

11. The method of treating an object in claim 10 wherein said circulating unsaturated mixture to improve said drying of said object.

12. The method of treating an object in claim 11 wherein said circulating unsaturated mixture is compressed and cooled to improve said drying of said object.

* * * * *